United States Patent [19]

Harris

[11] 4,102,093

[45] Jul. 25, 1978

[54] INSECT CONTROL SYSTEM

[76] Inventor: William F. Harris, 137 Catamount Rd., Tewksbury, Mass. 01876

[21] Appl. No.: 844,883

[22] Filed: Oct. 25, 1977

[51] Int. Cl.[2] ..... E04B 1/72

[52] U.S. Cl. ..... 52/101; 52/305; 294/25

[58] Field of Search ..... 52/101, 302, 303, 305, 52/741, 743; 294/25, 26; 81/1 R

[56] References Cited

U.S. PATENT DOCUMENTS

| | | | |
|---|---|---|---|
| 2,177,397 | 10/1939 | Woodrow | 294/25 |
| 2,209,068 | 7/1940 | Blanchard | 294/23.5 |
| 2,774,178 | 12/1956 | Nelson | 81/1 R |
| 2,868,010 | 1/1959 | Murphy | 52/303 |
| 2,891,615 | 6/1959 | Farrell | 160/369 |
| 3,220,079 | 11/1965 | Aggson | 52/302 X |
| 3,257,929 | 6/1966 | Kortvely | 98/29 |
| 3,304,672 | 2/1967 | Bakke | 52/302 X |
| 3,429,084 | 2/1969 | Brewer | 52/101 |
| 3,551,016 | 12/1970 | Hooper | 294/25 |
| 3,780,393 | 12/1973 | Gaetke | 294/1 R X |

*Primary Examiner*—Alfred C. Perham

[57] ABSTRACT

An insect control system for buildings of masonry construction and the like comprises a perforated, flexible resilient sheet member of width and height each greater than the width and height respectively of the weep hole with which it is to be used; and an inserter that has a blade of width and height less than the width and height resectively of the weep hole with which it is to be used, and a manipulating handle for securance to the blade.

7 Claims, 6 Drawing Figures

INSECT CONTROL SYSTEM

This invention relates to insect control systems and more particularly to a system for inserting a screen or similar member in a weep hole in a masonry foundation or the like.

In an ordinary house of masonry construction, a series of weep holes are left in the mortar joints near ground level primarily for ventilation. Ordinarily the weep holes are provided between regular bricks or between regular blocks by omitting all or portion of the mortar seal between the two bricks or blocks. Because of the proximity of the weep holes to ground level, the holes are a point of entrance for various types of insects.

Because so many masonry homes are built with open weep holes, a need exists to provide a system that would enable the ordinary home owner, who has no special skill and no special training, to efficiently and economically seal the weep hole against entry of insects.

In accordance with the invention there is provided an insect control system for buildings of masonry construction and the like comprising a perforated, flexible resilient sheet member of width and height each greater than the width and height respectively of the weep hole with which it is to be used; and an inserter that has a blade of width and height less than the width and height respectively of the weep hole with which it is to be used, and a manipulating handle for securance to the blade. The system is operated by placing the sheet member over the weep hole, then placing the inserter blade in the center of the sheet member, and pushing the inserter blade into the weep hole. By this insertion operation, the sheet member is inserted into the weep hole with its peripheral edges deflected and in firm engagement with the margins of the weep hole. After insertion of the sheet member, the inserter blade is removed. The inserted sheet member is effective to block the entry of insects into the building through the weep hole while not impairing ventilation. The inserted sheet member in the weep hole is not noticeable, but can be removed by the use of a small wire hook, if necessary.

In a particular embodiment, a system designed for use with weep holes formed between spaced regular bricks includes a fine mesh screen of octagonal shape dimensioned so that the peripheral marginal area of the screen is about one-half inch larger than, and corresponds in shape to, the peripheral dimensions of the weep hole with which it is to be used. The inserter is a one-piece member of molded plastic that has a blade corresponding in shape to the weep hole but of smaller dimensions so that a peripheral margin of at least about one-eighth inch in provided between the blade and the weep hole. Secured to the blade is a stop member effective to limit the depth to which the blade may be inserted in the weep hole and an integral handle.

The system enables insertion of sheet members into weep holes easily, quickly and economically, in contrast with far more complicated devices designed to be incorporated in weep holes during construction and provides an effective screen against invading insects.

Other features and advantages of the invention will be seen as the following description of a particular embodiment progresses, in conjunction with the drawing, in which.

DESCRIPTION OF PARTICULAR EMBODIMENT

Figure 1:
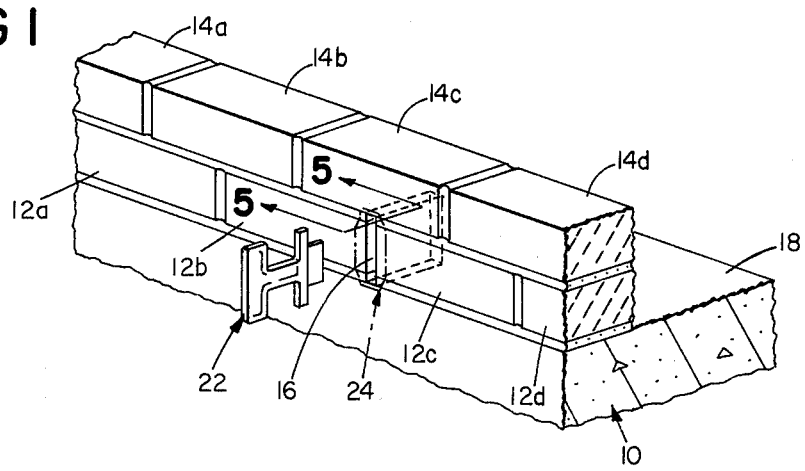
FIG. 1 is a fragmentary perspective view of masonry construction showing use of the invention.
Figure 2:
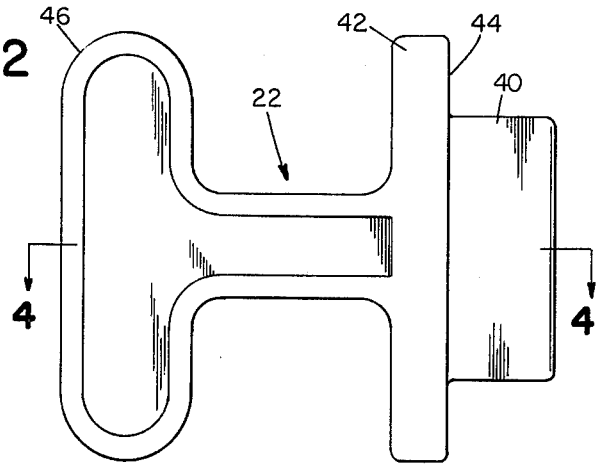
FIG. 2 is a plan view of an inserter member in accordance with the invention.

With reference to the drawing, FIG. 1 shows a section of a brick veneer wall having a masonry base 10, a lower course of bricks 12*a*, 12*b*, 12*c*, 12*d*, and a second course of bricks 14*a*–14*d*, with the bricks in alternate courses staggered in conventional manner. In lower course 12, mortar is eliminated in the joint between the adjacent ends of bricks 12*b* and 12*c* to form a weep hole 16. The upper surface 18 of block 10 forms the lower edge of weep hole 16, and the lower surface 20 of brick 14*c* forms the upper edge of the weep hole, and the opposing ends of bricks 12*b* and 12*c* form the side edges of the weep hole. The front and the back of the weep hole are open to permit the passage of air therethrough for ventilation.

Figure 3:
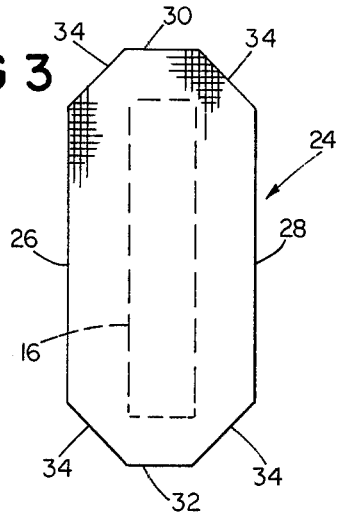
FIG. 3 is a front view of a sheet member in accordance with the invention.
Figure 4:
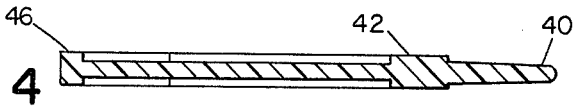
FIG. 4 is a sectional view along the line 4—4 of FIG. 2.

The insect control system includes a molded plastic inserter member 22 and a fine mesh aluminum screen 24. In this embodiment, the weep hole 16 (as indicated in FIG. 3) has a width of about $\frac{1}{2}$ inch and a height of about 3 inches. Screen 24 has parallel side edges 26, 28 spaced about $1\frac{5}{8}$ inch apart, parallel top and bottom edges 30, 32 spaced about $3\frac{1}{2}$ inches apart, and inclined corner edges 34, each about $\frac{3}{4}$ inch in length, providing a flexible resilient perforated sheet member of octagonal shape.

The cooperating inserter member 22 has a blade 40 $\frac{1}{8}$ inch in thickness, $2\frac{1}{4}$ inches in height, and $\frac{7}{8}$ inch in depth. At the base of blade 40 is projection 42 which defines stop surface 44 that extends above and below blade 40. Extending rearwardly from projection 42 is handle 46.

Figure 5:
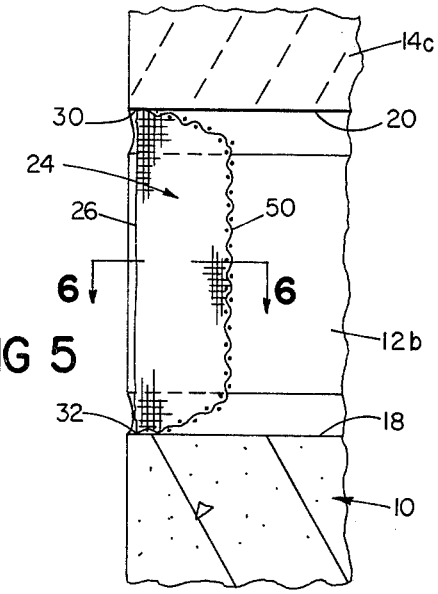
FIG. 5 is a sectional view through a weep hole taken generally along the line 5—5 of FIG. 1 showing a sheet member in place.
Figure 6:
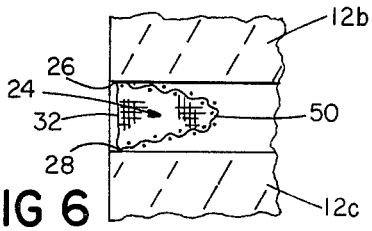
FIG. 6 is a sectional view taken along the line 6—6 of FIG. 5.

In operation, inserter 22 is grasped in one hand, and screen 24 is positioned over the weep hole, as indicated in FIG. 1, with the other hand. The inserter blade 40 is then placed in the center of screen 24 and the blade is pushed into weep hole 16 to the full depth of the inserter blade so that stop surface 44 abuts the outer surfaces of the block 10 and brick 14*c*. In this position, screen 24 has been inserted approximately $\frac{7}{8}$ inch into the weep hole and its marginal edges 26, 28, 30, 32 are inserted slightly beyond the outer face of brick 14*c* and block 10 as indicated in FIG. 5. The central portion 50 of screen 24 remains generally planar and is disposed parallel to the front surfaces of the masonry construction while the marginal portions of the screen 24 are bent so that their edges firmly engage the surfaces of the weep hole, frictionally securing the screen 24 in place. Thus the inserted screen 24 provides a complete closure against intrusion of insects while allowing the desired ventilation of the building.

The insect control system may be furnished with a supply of perforated sheet members 24 and one or more inserter members 22. The inserter members may have integral blades 40 of graduated sizes for use with a range of weep hole configurations, or an inserter member may be provided with replaceable blade elements 40 of different sizes. While a particular embodiment of the invention has been shown and described, various changes within the spirit and scope of the invention as defined in the claims will be apparent to those skilled in the art.

What is claimed is:

1. An insect control system for buildings of masonry construction and the like comprising a perforated, flexible resilient sheet member of width and height each greater than the width and height respectively of the weep hole with which it is to be used; and an inserter member that has a blade of width and height less than the width and height respectively of the weep hole with which it is to be used and a manipulating handle for securance to the blade, said sheet member being adapted to be inserted into the weep hole by said inserter blade so that its peripheral edges are deflected and in firm engagement with the margins of the weep hole, the inserted sheet member being effective to block the entry of insects into the building through the weep hole while not impairing ventilation.

2. A system according to claim 1 wherein said sheet member is a wire screen and said inserter member is of molded plastic.

3. A system according to claim 1 wherein said sheet member is of octagonal shape.

4. A system according to claim 1 wherein said inserter member further includes a stop portion effective to limit the depth to which said blade may be inserted in the weep hole.

5. A system according to claim 1 wherein said sheet member is fine mesh wire screen and said blade is an elongated member with a straight leading surface with rounded edges to smoothly flex said screen into position in said weep hole.

6. A system according to claim 5 wherein said inserter member is a one-piece member of molded plastic that has a blade corresponding in shape to the weep hole but of smaller dimensions so that a peripherial margin of at least about ⅛ inch is provided between the blade and the weep hole and a stop portion of larger dimension than said weep hole effective to limit the depth to which said blade may be inserted in the weep hole.

7. A system according to claim 6 wherein said screen is of octagonal shape dimensioned so that the peripheral marginal area of said screen is about ½ inch larger than, and corresponds in shape to, the peripheral dimensions of the weep hole with which it is to be used.

* * * * *